US006902196B1

(12) United States Patent
Olson

(10) Patent No.: US 6,902,196 B1
(45) **Date of Patent: *Jun. 7, 2005**

(54) ADJUSTABLE BOOKMARKER AND READING ACCESSORY CASE

(76) Inventor: Gary E. Olson, 3913 S. Pagosa St., Aurora, CO (US) 80013-3209

( * ) Notice: Subject to any disclaimer, the term of this patent is extended or adjusted under 35 U.S.C. 154(b) by 0 days.

This patent is subject to a terminal disclaimer.

(21) Appl. No.: 10/701,034

(22) Filed: Nov. 3, 2003

Related U.S. Application Data

(63) Continuation of application No. 10/041,798, filed on Jan. 7, 2002, now Pat. No. 6,641,172.

(51) Int. Cl.[7] ..... B42D 9/00

(52) U.S. Cl. ..... 281/42; 116/238; 116/239; 281/15.1; 281/27.1; 402/73; D19/34

(58) Field of Search ..... 116/234–240; 281/15.1, 21.1, 27.1, 42, 45; 402/8, 73, 80 R, 500, 502; D19/34

(56) References Cited

U.S. PATENT DOCUMENTS 5,022,342 A * 6/1991 Davis ..... 116/236
5,408,950 A * 4/1995 Porto ..... 116/239
5,443,029 A * 8/1995 Garnet ..... 116/235
D384,373 S * 9/1997 Wong ..... D19/34
6,352,048 B1 * 3/2002 Scott ..... 116/238
6,641,172 B1 * 11/2003 Olson ..... 281/42

* cited by examiner

*Primary Examiner*—Monica S. Carter
(74) *Attorney, Agent, or Firm*—Ramon L. Pizarro; Edwin H. Crabtree

(57) ABSTRACT

A book-marking device for marking one or more page locations in a book. The device includes a pocket having a first end, a second end, and a mid-section, the pocket being of a pocket length between the first end and the second end the pocket length being adapted to extend approximately the cover length, and an elastic strap, the elastic strap extending from the first end and terminating in a strap end, and being of a relaxed length that is approximately as long as the pocket length. The elastic strap is adapted for extending around the cover to the second end of the pocket, retaining the pocket against the cover.

15 Claims, 5 Drawing Sheets

ADJUSTABLE BOOKMARKER AND READING ACCESSORY CASE

REFERENCE TO RELATED APPLICATIONS

This application is a continuation of my application having Ser. No. 10/041,798, filed Jan. 7, 2002, now U.S. Pat. No. 6,641,172, incorporated herein by reference in its entirety.

BACKGROUND OF THE INVENTION (a) Field of the Invention

This invention generally relates to a pencil case that also serves as a bookmarker. More particularly, but not by way of limitation, to a pencil case that includes an adjustable band that accommodates varied thicknesses of material, and thereby accepts accommodates various numbers of pages to mark a location in a book, for example.

(b) Discussion of Known Art

When studying from a book, particularly a book that may take many days to read, it is well known that it is convenient to use a book-marking device to keep track of the location in the book where the reader has left off. Additionally, it is convenient for the reader to carry additional materials that are to be used to write or mark the book in order to assist the reader in reviewing the material at a later date. In order to carry all of the materials needed for underlining, highlighting, and jotting down notes about the material being read, the reader has to carry a separate pencil pouch or other device that can hold things such as pencils, markers, erasers, rulers, magnifying glasses, and similar materials.

Known devices that serve to mark pages in a book can be found in the following U.S. patents:

| U.S. Pat. No. | Inventor | Date of Issue |
|---|---|---|
| 6,109,204 | Hoey et al. | Aug. 29, 2000 |
| 5,501,171 | Leake | Mar. 26, 1996 |
| 5,456,497 | Ross, Jr. | Oct. 10, 1995 |
| 5,325,959 | Goldberger | Jul. 5, 1994 |
| 4,162,800 | Gonot, Jr. et al. | Jul. 31, 1979 |
| 3,898,951 | Clare | Aug. 12, 1975 |
| D449,648 | Andler | Oct. 23, 2001 |

None of these devices, however, allows a user to carry a variety of writing, marking, or reading instruments together at one time. Additionally, most of these devices suffer from limitations associated with the use of non-extendible materials for marking page locations. One significant limitation associated with these fixed-length materials is that they can bind against the pages upon opening the book. The binding is associated with the relative sliding and rearranging of the pages as the book is opened to a particular location in the book, and the pages are turned about the spine of the book. Devices such as the Hoey et al. device, described in U.S. Pat. No. 6,109,204, or the Goldenberger device are made of entirely inelastic material, and do not accommodate the movements of the pages when the book is opened.

Still another device, which accommodates movements of the pages of a book, is found in the patent to Ross, Jr. The Ross, Jr., device is designed to hold a book open at a location, and allow one handed support of the book while in the open position. However, this device does little for addressing the need to carry several pens, markers, erasers, and other personal belongings. Furthermore, the Ross, Jr., device includes a small section of elastic material that is used to bridge the ends of a section of inelastic material that is used to support a handle. The handle is used to allow a person to hold the book.

Because the Ross, Jr. device is primarily a book support device, the elastic portion is very short in relation to the handle support portion. The length of elastic material to be incorporated in this type of device must be kept at a minimum due to the well known relationship between total elongation or strain and a given amount of stress. Thus, in order to maintain the stability of a device that is used to support a book, these devices must limit the amount of elongation created by the device. This reduction in the amount of elongation limits the versatility of this type of device by limiting the size of a book that can be accommodated by the device.

Thus, a review of known devices demonstrates that there remains a need for a device that can be used to mark the reading location in a book and that can accommodate a variety of book sizes.

There remains a need for a book marking device that can accommodate a variety of different sizes of books, and that can be used to carry a variety of materials used while reading, for example pencils, highlighting pens or markers, erasers, magnifying glasses, rulers, and the like.

There remains a need for a device that can be used in a three-ring binder and which can be easily transferred to a book where the device is used to mark locations in the book.

There remains a need for a device that can be used to store materials in a three-ring binder and mark the page location in the binder where the person is to commence taking notes.

There remain a need for a device that can be securely supported from a book while carrying a variety of reading materials, and which allows a user to mark a variety of different pages in the book at one time.

SUMMARY

It has been discovered that the problems left unanswered by known art can be solved by providing a book-marking device for marking a page location in a book the book having a cover of a cover length, the book-marking device includes:

An elongated pocket having a first end, a second end, and a mid-section;

An elastic strap, the elastic strap extending from the first end of the elongated pocket; and A connector, the connector being attached to the pocket at a location near the second end of the pocket, so that the elastic strap is adapted for extending around the cover to the second end of the pocket, retaining the pocket against the cover.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
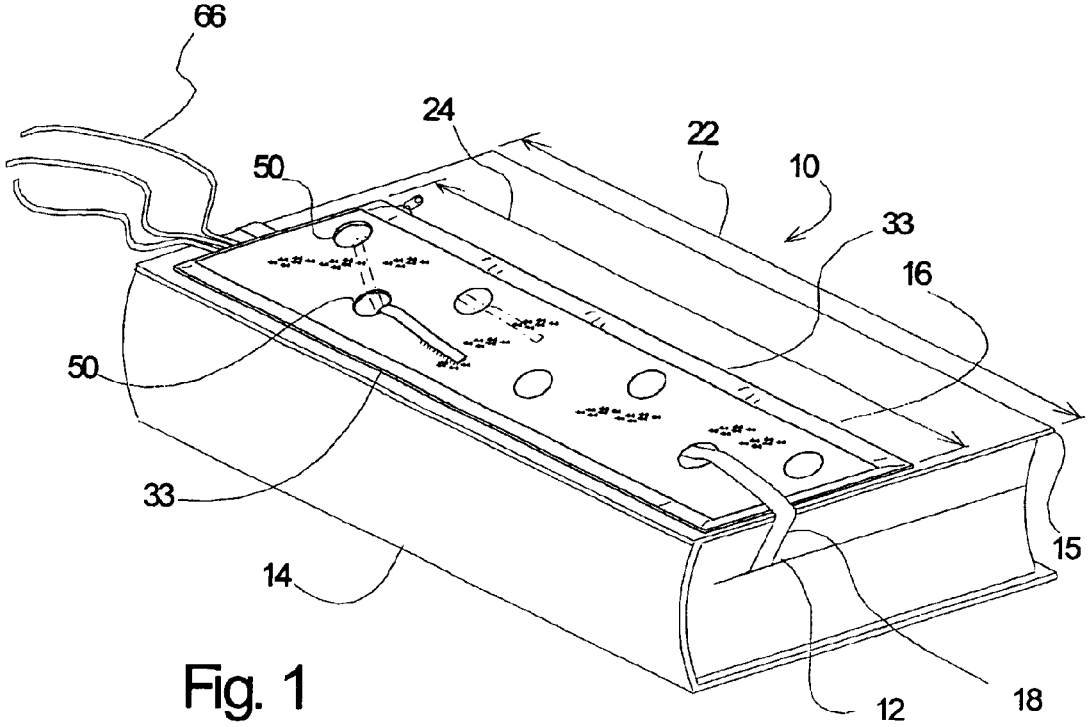
FIG. 1 is a perspective view of an embodiment of the invention in use on a book, the device being used over the book cover.
Figure 2:
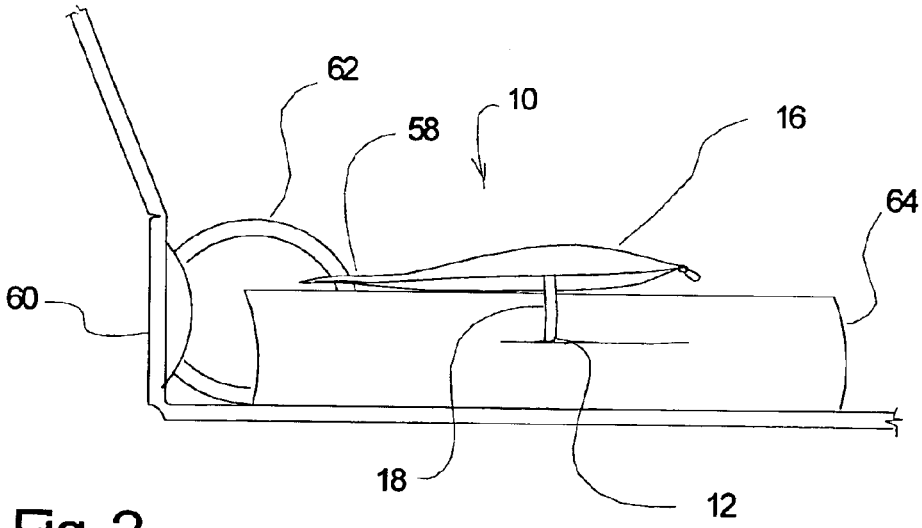
FIG. 2 is an end view of an example of the invention being used on a ringed binder.

Turning now to FIG. 1 where a book-marking device 10, which is particularly useful for marking a page location 12 in a book 14, and for carrying a variety of articles used while reading. These articles are well known, and include pencils, highlighters, erasers, mints, reading glasses, magnifying glasses, rulers, paper tissues, and other articles. These articles have not been illustrated, as they are well known.

As shown on FIG. 1, the book-marking device 10 has been adapted for use with the book 14, by providing structure that will allow the book-marking device 10 to engage the cover 15 of the book 14. While it is contemplated that the disclosed device may be used on hard-cover books, it is contemplated that the book-marking device 10 may be used with paper-back books as well as with hard-backed books. When used with paper-back books, the book-marking device 10 would simply be stretched over the read or un-read pages to mark the location where the reader left off. Thus, as illustrated in FIG. 1, the book-marking device 10 includes an elongated pocket 16, an elastic strap 18, and a connector 20 that is mounted from the elongated pocket 16.

It is contemplated that the book-marking device 10 may be of various sizes, but it is contemplated that it would be advantageous to match the length of the elongated pocket 16 with the length of the spine of the book 14, which also corresponds with the cover length 22 of the cover 15 of the book 14. By matching the cover length 22 to the length 24 of the elongated pocket 16, the user takes advantage of the book's rigidity to lend support to the elongated pocket 16.

Figure 3:
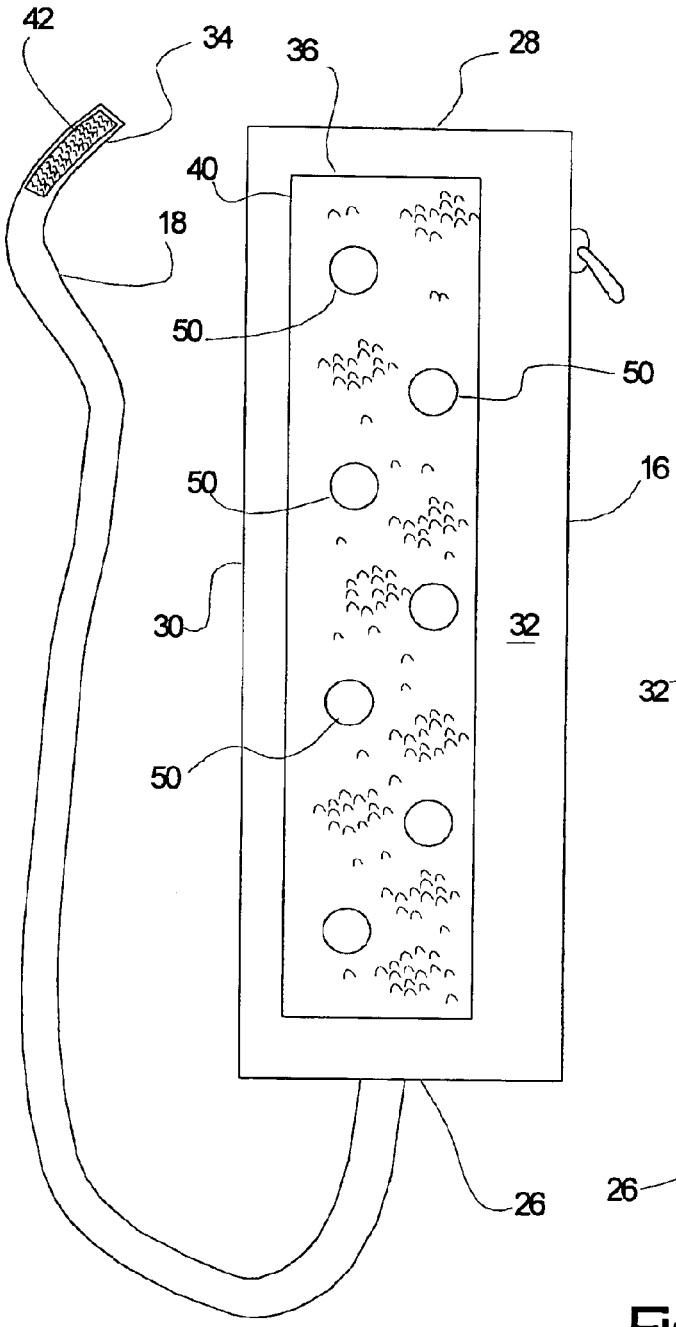
FIG. 3 is a plan view of an example of the invention. The view illustrating the length relationship between the pocket and the elastic strap.
Figure 4:
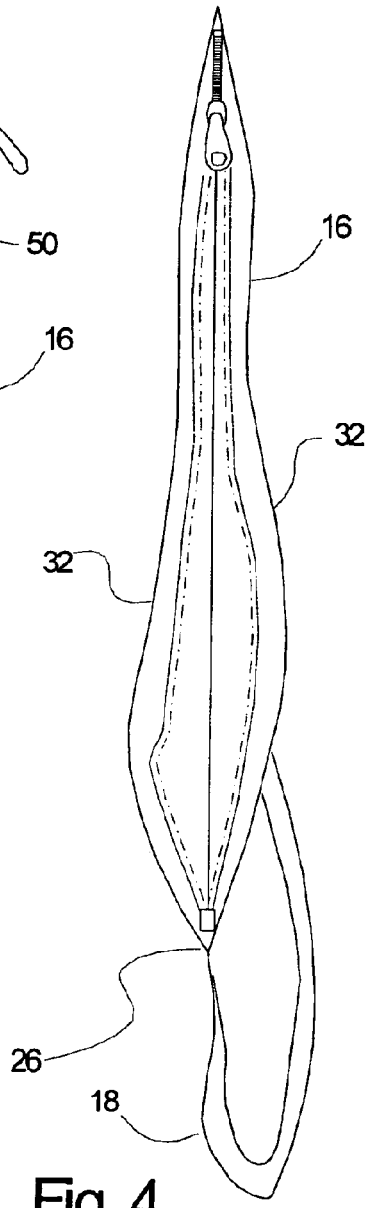
FIG. 4 is a side view of the edge of the example shown in FIG. 3.

As illustrated in the examples shown in FIGS. 1, 3, and 4, the elongated pocket 16 includes a first end 26, a second end 28, and a mid-section 30 that is located between the first end 26 and the second end 28. It is contemplated that that the elongated pocket 16 may be made from a pair of sheets 32 of an inelastic material, such as cloth, leather, and plastics. The sheets 32 should be of a length that is similar to the pocket length 24, so that the pair of sheets 32 having a pair of edges 33 may be attached to one another to define the first end 26 and the second end 28 of the pocket length 24, which extends approximately the cover length 22.

Turning now to FIGS. 1 through 6 it will be understood that the elastic strap 18 will preferably extend from the first end 26 of the elongated pocket 16 and terminate in a strap end 34. It is contemplated that the elastic strap 18 will being of a relaxed length that is approximately as long as the pocket length 24. By providing an elastic strap 18 that is of a length that is nearly as long or longer than the pocket length, the system is capable of accommodating various sized books and accommodate the movement of the pages and variations in the stacking of the pages as the book is opened. The ability to accommodate these movements is due to the fact that the spring force exerted by an elastic body is equal to the spring constant for that body times the amount of elongation. The spring constant is the ratio of change in length as compared to the overall length of the spring, for a given amount of force. Therefore, holding all other variables constant, the longer the spring, the smaller the force required to extend the spring a given distance. Thus, as will be understood from the explanation found below, the disclosed arrangement would provide a very gently force or a very strong supporting force depending on the needs of the user.

Also illustrated in FIGS. 1, and 3–6, strap end 34 of the elastic strap 18 will cooperate with a connector 36 that is on the elongated pocket 16, and preferably, near the second end 28 of the elongated pocket 16. This arrangement will allow the user to extend the elastic strap 18 around the cover, through the desired page, to the second end of the elongated pocket 16, where it will cooperate with the connector 36 to retain the elongated pocket 16 against the cover 15 of the book 14. It is important to note that it is contemplated that both ends of the elastic strap 18 may be permanently fastened to the first end 26 and the second end 28 of the elongated pocket 16. Still further, it is also contemplated that the second end 26 may include an opening or mouth 27, illustrated in FIG. 10, that includes a hook and loop closure on opposing sides of the mouth. This hook and loop closure would then be used to engage strap end 34.

Figure 5:
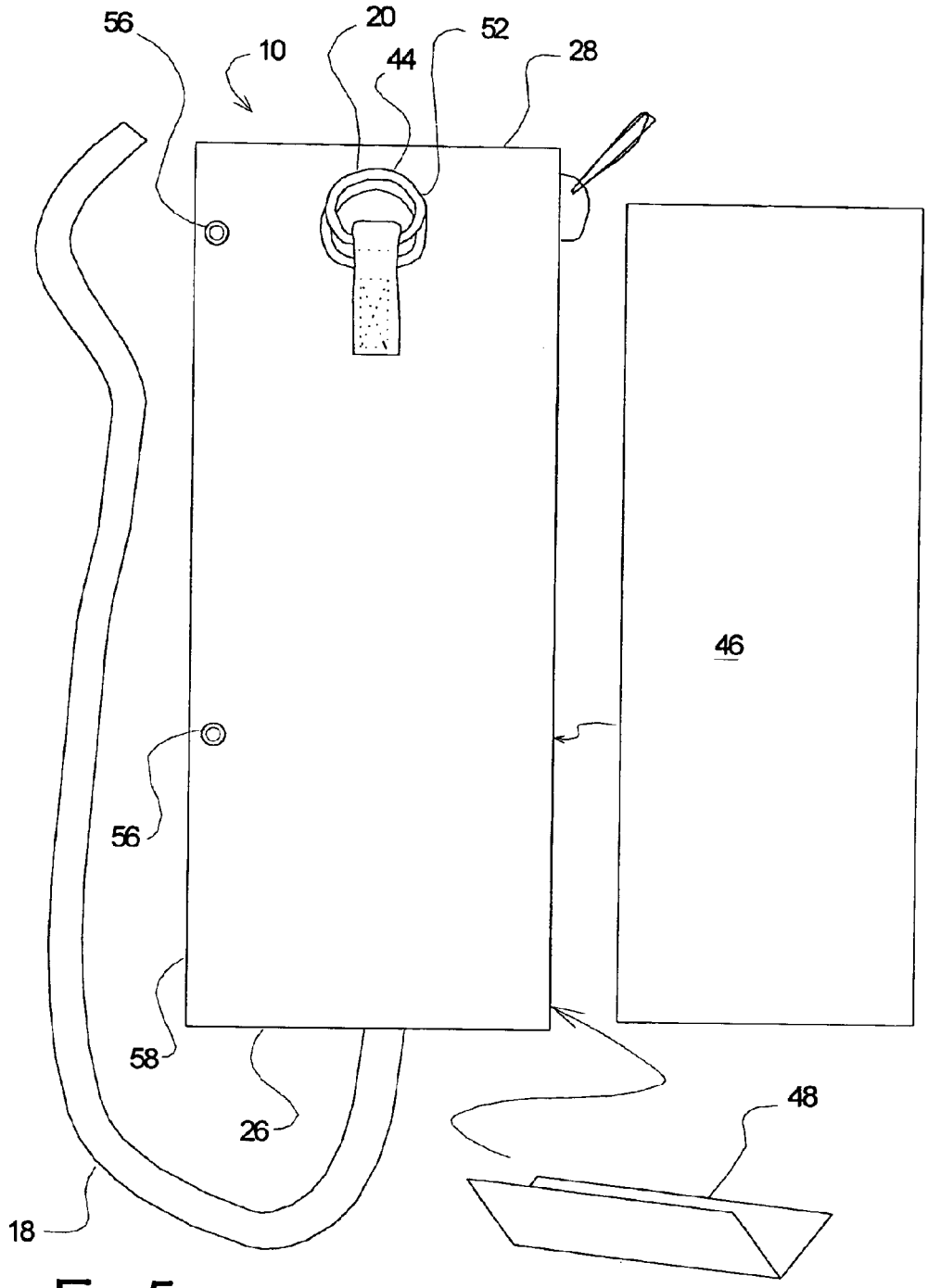
FIG. 5 is a plan view of another example of the invention. The view also illustrating the divider and sheet of impermeable material used to shield the end of the pocket.
Figure 9:
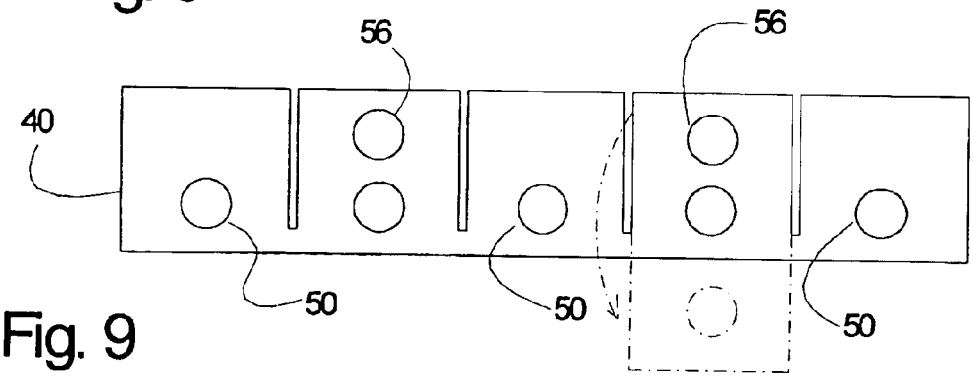
FIG. 9 illustrates another example of an anchoring sheet of hook and loop material, the sheet including tabs with perforations that can accept the rings from a ringed binder.

As shown in FIGS. 1, 3, and 9, it is contemplated that the connector 36 will include a sheet of hook and loop material 40 mounted on the elongated pocket 16. The a sheet of hook and loop material 40 may cooperate with a mating section of hook and loop material 42 found on the strap end 34. However, as shown in FIG. 5, it is contemplated that a buckle 44, such as a set of D-rings, snaps or other devices may also be used. It is also important to note that while FIG. 1 illustrates the sheet of hook and loop material 40 on the outward facing panel, it is contemplated that the sheet of hook and loop material 40 may be mounted on the panel 32 that faces the cover 15. Additionally, by placing the sheet of hook and loop material 40 against the book cover 15, the user exposes the opposing panel 32, allowing the placement of advertising material, logos, legends or other indicia on the opposing panel 32.

Also shown in FIG. 5 is that it is contemplated that the book-marking device 10 may be used with a divider plate 46, that may be removable, and which mounts within the elongated pocket 16 and extends between the first end 26 and the second end 28 of the elongated pocket 16. Additionally, a sheet of impermeable material 48 that is adapted for fitting within the elongated pocket 16 at a location near the first end 26 or the second end 28 of the elongated pocket 16. This sheet of impermeable material will prevent seepage of fluids, such as ink from pens, from within the elongated pocket. Additionally, the sheet of impermeable material 48 will prevent damage to the elongated pocket 16 from pens, pencils, or other sharp objects that may be stored in the elongated pocket 16. It is also contemplated that this area of impermeable material may be formed by simply coating the material of the elongated pocket 16 with a suitable paint or polymer that will make the section of the elongated pocket 16 impermeable.

FIGS. 1, 6–7, and 9 illustrate advantages of the cooperation of using and mating section of hook and loop material 42 on the strap end 34 and sheet of hook and loop material 40 as the mating connector 36. Importantly, the sheet of hook and loop material 40 will benefit from the inclusion of several apertures 50, and preferably at least two apertures 50 that will allow the elastic strap 18 to be inserted into one of the apertures 50, under the sheet of hook and loop material 40, then up through the second of the apertures 50, so that the mating section of hook and loop material 42 on the end of the elastic strap 18 may then attach to the hook and loop material on the surface of the sheet of hook and loop material 40. The use of two rows of staggered apertures 50, as shown on FIG. 1, will allow the user to weave the elastic strap 18 through several apertures 50 to take up excess length of elastic strap 18.

Figure 6:
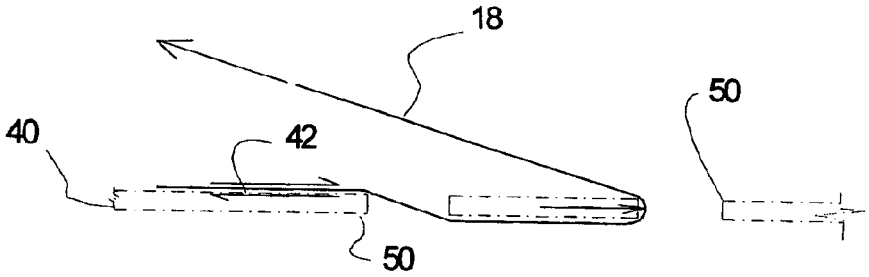
FIG. 6 is side view illustrating the cooperation of the elastic strap and the apertures in the anchoring sheet of hook and loop material.
Figure 7:
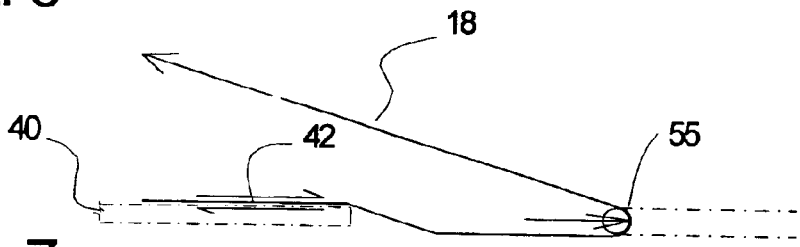
FIG. 7 illustrates the use of a D-ring to re-direct the tension on the elastic strap and place the hook and loop material on the elastic strap under shear load, reducing out-of-plane loads.
Figure 8:
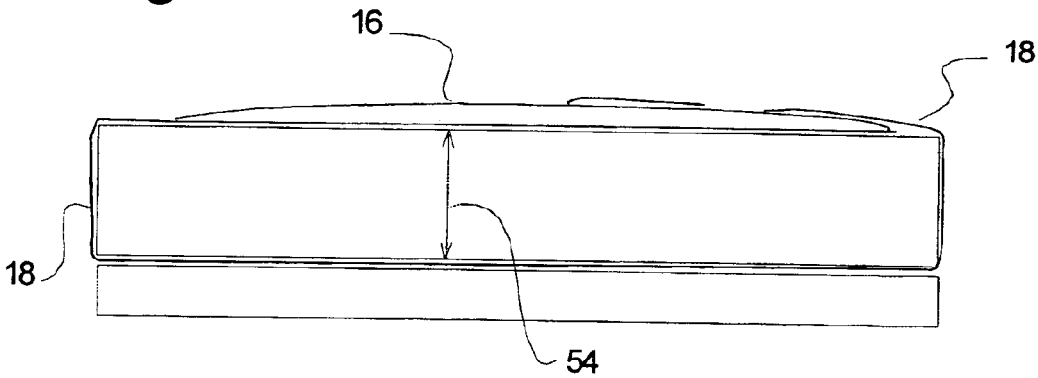
FIG. 8 illustrates the use of an example of the invention over a section of a book.

FIGS. 6, and 8 illustrate the cooperation of the apertures 50, the sheet of hook and loop material 40, and the elastic strap 18 to ensure that the strap end 34 will not be accidentally released from the sheet of hook and loop material 40. The hook and loop material found in these connections is particularly strong when loaded in shear, and relatively weak when loaded off-plane, as would be when the sheet hook and loop is peeled away from another sheet of hook and loop material. By passing the section of elastic strap 18 through one of the apertures 50 and then allowing the strap end 34 to extend through the second aperture and engage the sheet of hook and loop material 40, the load that can be transmitted through the elastic strap 18 can only be in shear, or along the plane of the sheet of hook and loop material 40, as shown in FIGS. 6 and 7. It is important to note that while this effect can be accomplished with the use of at least two apertures 50, it is also contemplated that this effect can be accomplished with a D-ring 52 or another device that would re-direct the angle of the strap end 34. FIG. 8 illustrates the routing of the elastic strap 18, and the expansion 54 or movement of the pages 56 of the book 14 as the book is opened.

Turning once again to FIGS. 2 and 5, it will be understood that it is contemplated that at least two apertures 56 along an edge 58 of the elongated pocket 16 will allow the use of the book-marking device 10 with a ringed binder 60. The apertures 56 will accept the rings 62 of the ringed binder 60 and position the book-marking device 10 within the ringed binder 60, allowing the user to use the elastic strap 18 to mark the location in the loose leafs 64 held by the binder 60.

Figure 10:
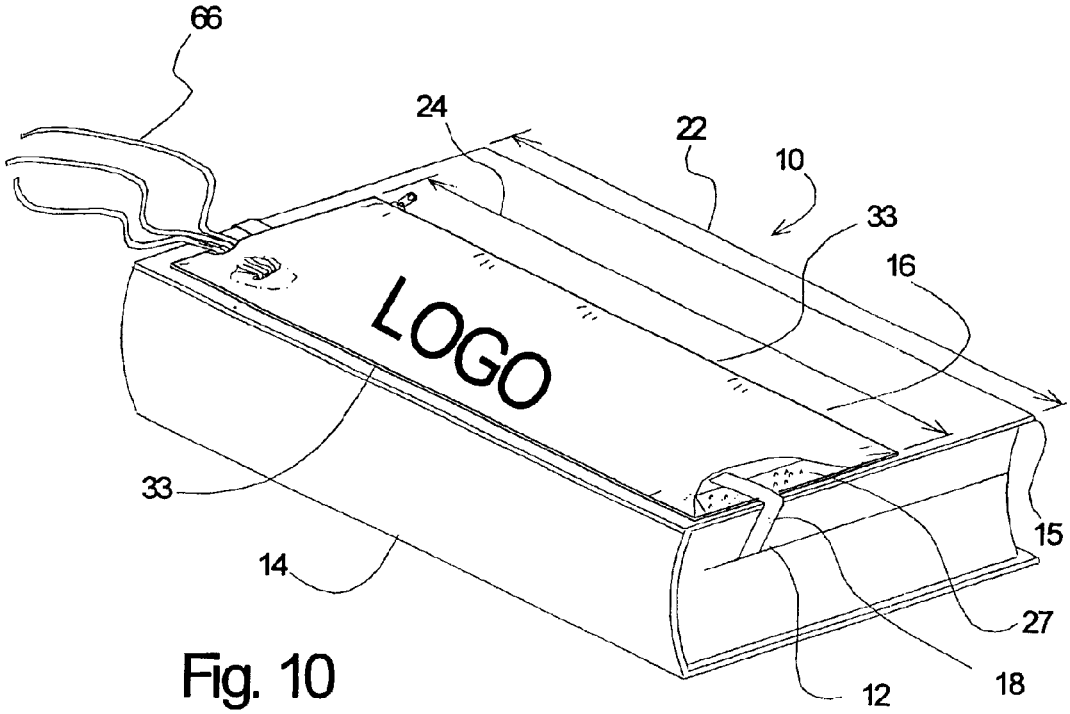
FIG. 10 illustrates the use of an aperture to allow retraction of marker ribbons and the placement of a logo on one of the panels.

Additionally, FIG. 1 illustrated the addition of multiple ribbons 66 to allow the user to mark several locations on the same book. It is further contemplated that the ribbons 66 may extend from an aperture in one of the ends 26 or 28, and thus allow the ribbons 66 to be retracted by pulling the ribbons into the interior of the elongated pocket 16, as illustrated in FIG. 10.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A book-marking device for marking a page location in a book the book having a cover of a cover length, the book-marking device comprising:

a pocket having a first end, a second end, and a mid-section, the pocket being of a pocket length between the first end and the second end the pocket length being adapted to extend approximately the cover length;

a plurality of ribbons attached to the pocket to allow the user to mark a plurality of locations with the ribbons;

an elastic strap, the elastic strap extending from the first end and terminating in a strap end, and being of a relaxed length that is approximately as long as the pocket length; and a connector, the connector being attached to the pocket at a location near the second end of the pocket, so that the elastic strap is adapted for extending around the cover to the second end of the pocket, retaining the pocket against the cover, and allowing the user to mark several locations with the ribbons.

2. A book-marking device according to claim 1 wherein said elastic strap is greater than the pocket length.

3. A book-marking device according to claim 1 wherein said elastic strap is shorter than the pocket length.

4. A book marking device according to claim 1 wherein said connector is a buckle adapted for engaging the elastic strap.

5. A book-marking device according to claim 1 wherein said pocket comprises a pair of sheets having an aperture extending between the first end and the second end.

6. A book-marking device according to claim 1 wherein said pocket includes a pair of apertures adapted for cooperating with a set of retaining rings from a ringed binder.

7. A book-marking device for marking a page location in a book and for carrying a variety of articles used while reading, the book-marking device being adapted for use with the book, the book having a cover of a cover length, the book-marking device comprising:

an elongated pocket having a first end, a second end, and a mid-section, the pocket being made from a pair of sheets that are of a pocket length, the pair of sheets having a pair of edges attached to one another to define the first end and the second end of the pocket length being adapted to extend approximately the cover length;

a plurality of ribbons attached to the pocket to allow the user to mark a plurality of locations with the ribbons;

an elastic strap, the elastic strap extending from the first end and terminating in a strap end; and a connector, the connector being attached to the pocket and being adapted for retaining the strap end of the elastic strap against the pocket, so that the elastic strap is adapted for extending around the cover to the second end of the pocket, retaining the pocket against the cover and allowing the use of the plurality of ribbons to mark a plurality of locations in the book.

8. A book-marking device according to claim 7 wherein said pocket is made of a flexible, generally inelastic material.

9. A book-marking device according to claim 7 and further comprising a divider plate mounted within the pocket and extending between the first end and the second end of the pocket.

10. A book-marking device according to claim 7 and further comprising a sheet of impermeable material that is adapted for fitting within the pocket near the first end or the second end of the pocket, so that the sheet of impermeable material prevents seepage of fluids from within the pocket.

11. A system for marking a page location in a ringed binder or a book the ringed binder or book having a cover of a cover length, the system comprising:

an elongated pocket having a first end, a second end, and a mid-section, the pocket being made from a pair of sheets that are of a pocket length, the pair of sheets having a pair of edges attached to one another to define the first end and the second end the pocket length being adapted to extend approximately the cover length;

an elastic strap, the elastic strap extending from the first end and terminating in a strap end, and being of a relaxed length that is approximately as long as the pocket length, the elastic strap end having a section of hook and loop material;

a plurality of ribbons attached to the pocket to allow the user to mark a plurality of locations with the ribbons; and an adjustable connector, the adjustable connector being attached to the pocket at a location near the second end of the pocket, the adjustable connector comprising an anchoring sheet of hook and loop material, the anchoring sheet of hook and loop material having an upper surface and a lower surface and at least two apertures that extend through the upper surface and the lower surface, so that the section of hook and loop material of the elastic strap cooperates with the adjustable connector by being adapted for extending through the one of the at least two apertures, to the lower surface and then up through the other of the at least two apertures to allow the section of hook and loop material on the elastic strap to engage the upper surface of the anchoring sheet.

12. A system according to claim 11 wherein said pocket is made of a flexible, generally inelastic material.

13. A system according to claim 11 wherein said at least two apertures are positioned along an edge of the pocket.

14. A system according to claim 11 and further comprising a divider plate mounted within the pocket and extending between the first end and the second end of the pocket.

15. A system according to claim 14 and further comprising a sheet of impermeable material that is adapted for fitting within the pocket near the first end or the second end of the pocket, so that the sheet of impermeable material prevents seepage of fluids from within the pocket.

* * * * *